United States Patent [19]

Mielonen

[11] Patent Number: 4,637,234

[45] Date of Patent: Jan. 20, 1987

[54] CARTRIDGE LOCK

[75] Inventor: Pekka A. Mielonen, Reijola, Finland

[73] Assignee: Oy Wartsila AB, Finland

[21] Appl. No.: 640,106

[22] Filed: Aug. 13, 1984

[51] Int. Cl.[4] ..... E05B 29/06; E05B 67/36

[52] U.S. Cl. ..... 70/34; 70/366; 70/462; 70/DIG. 62

[58] Field of Search ..... 70/34, 365, 366, 379, 70/385, 386, 461, 462, DIG. 62

[56] References Cited

U.S. PATENT DOCUMENTS

| | | | |
|---|---|---|---|
| 1,643,480 | 9/1927 | Wiswell | 70/379 R X |
| 1,674,513 | 6/1928 | Jacobi | 70/DIG. 62 X |
| 2,948,140 | 8/1960 | Esten | 70/379 R |
| 3,186,196 | 6/1965 | Moberg | 70/34 |
| 3,821,886 | 7/1974 | Ladewig | 70/366 |
| 4,015,456 | 4/1977 | Moberg | 70/34 |
| 4,035,791 | 7/1977 | Katayama | 70/379 R X |
| 4,193,276 | 3/1980 | Lundberg | 70/34 |

FOREIGN PATENT DOCUMENTS

| | | | |
|---|---|---|---|
| 449281 | 6/1949 | Italy | 70/34 |
| 630057 | 10/1949 | United Kingdom | 70/379 R |

*Primary Examiner*—Robert L. Wolfe
*Assistant Examiner*—Russell W. Illich
*Attorney, Agent, or Firm*—Joan I. Norek

[57] ABSTRACT

A cartridge lock having an elongated body and a rotary disc assembly, locking shaft, and at least one bolting element disposed therein. The rotary disc assembly comprises a plurality of discs aligned concentrically within a cylinder, which cylinder is interconnected to one end of the locking shaft by means transmitting turning force thereto. The bolting element is disposed within an aperture within the body and is moved to a position partially protruding therefrom when a bearing surface of the locking shaft is rotated and presented to the bolting element. The rotation of the locking shaft is determined by key action turning the rotary disc assembly from a locked to an unlocked position and the reverse.

2 Claims, 10 Drawing Figures

FIG. 1
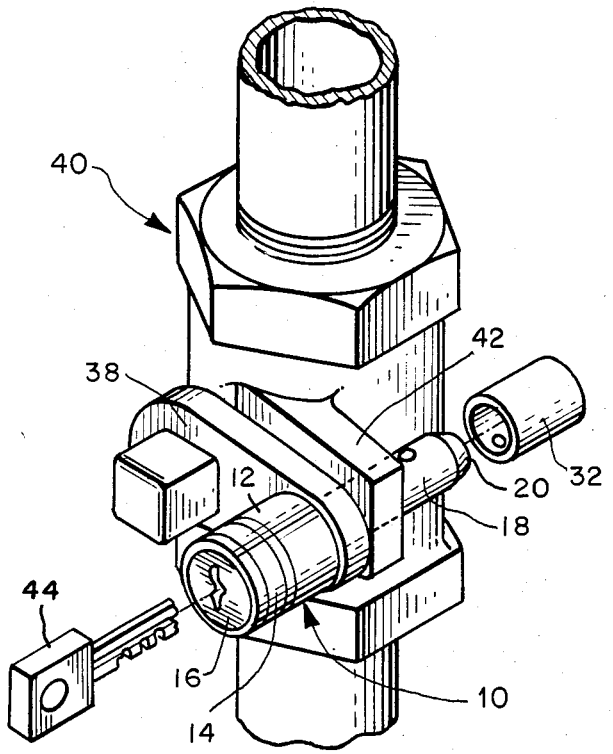
FIG. 2
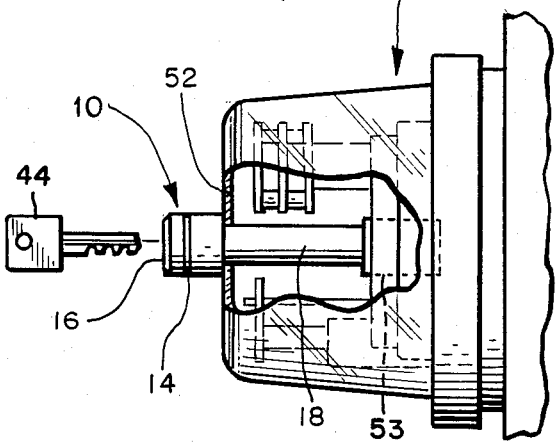
FIG. 3
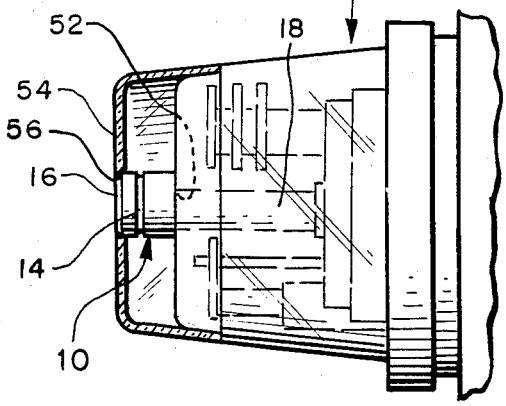
FIG. 4
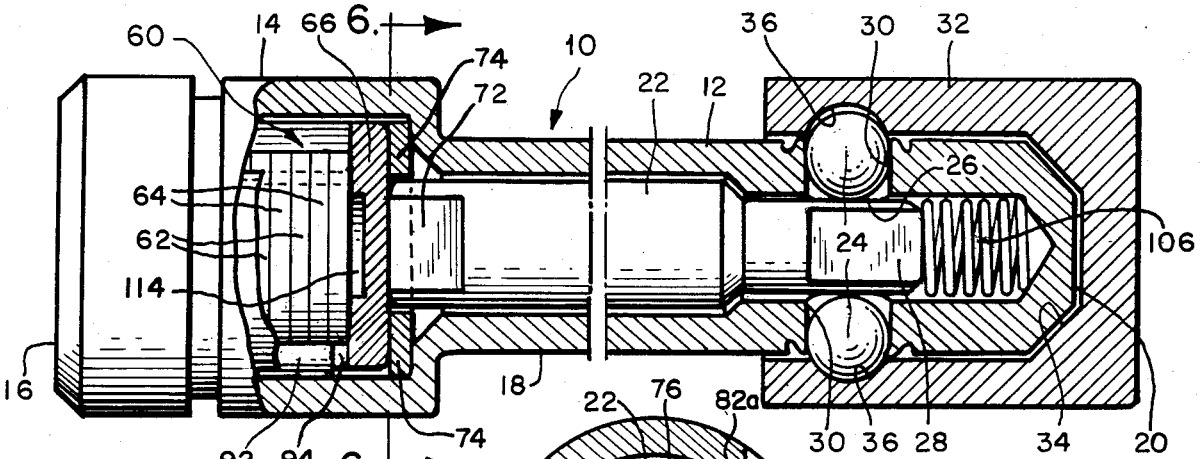
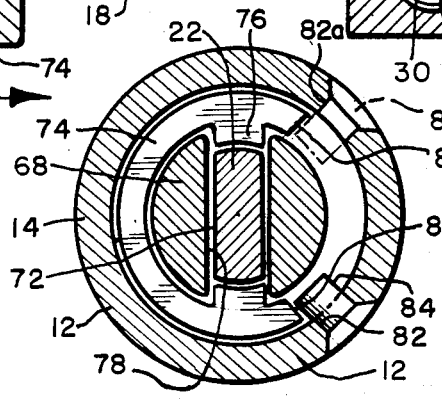
FIG. 6

FIG. 5
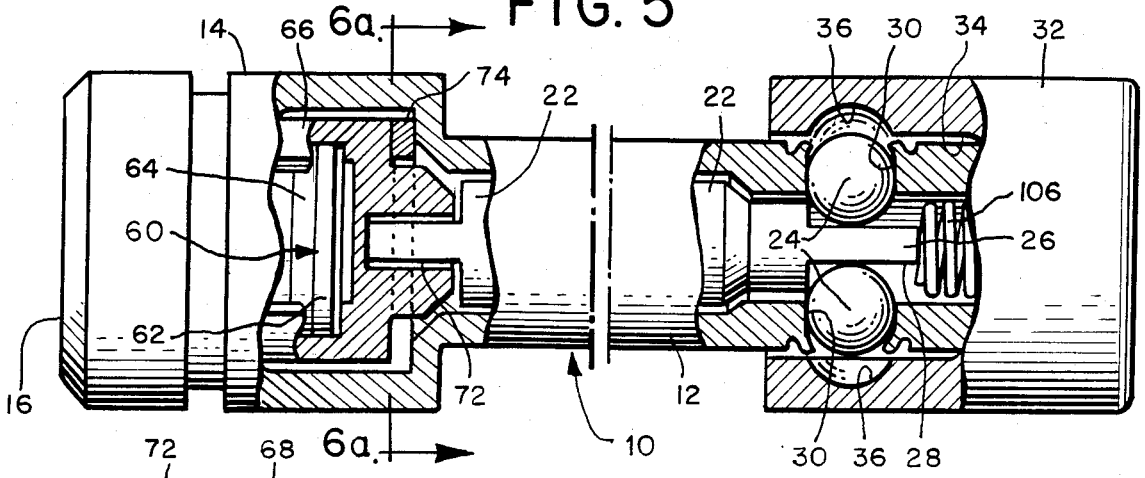
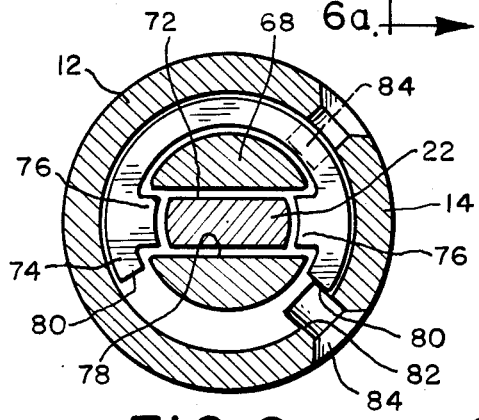
FIG. 6a
FIG. 7
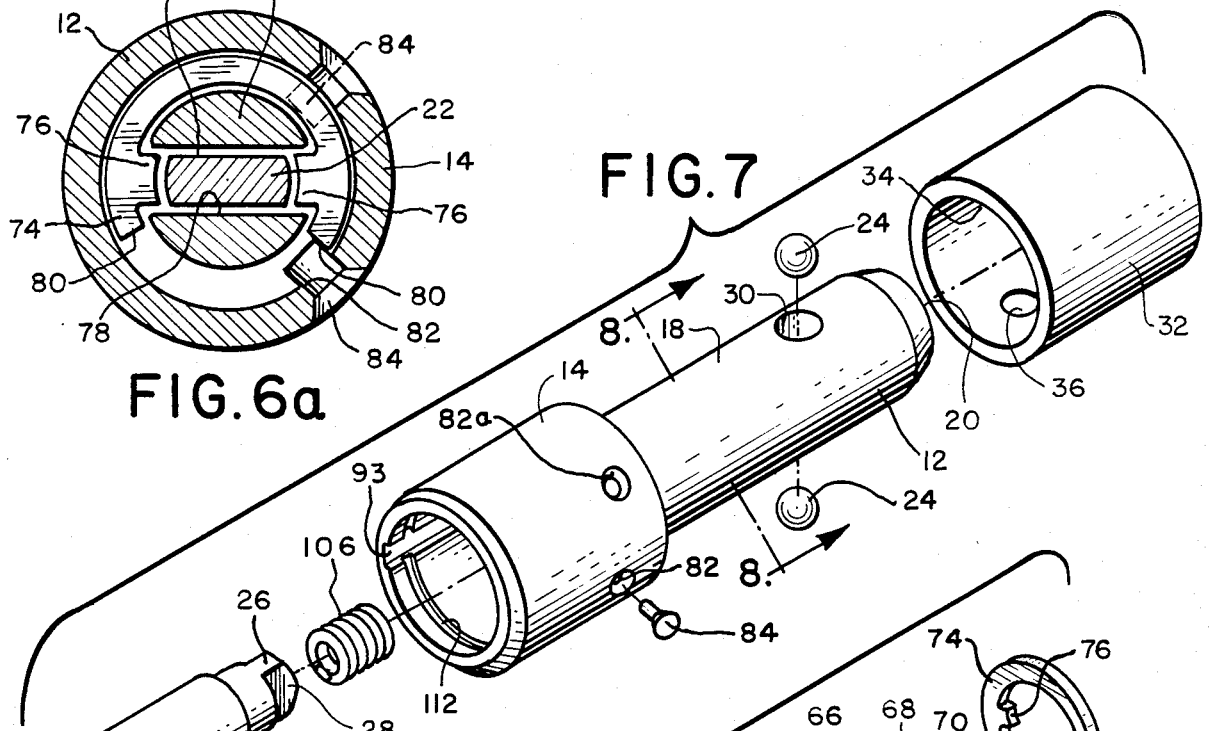
FIG. 7a
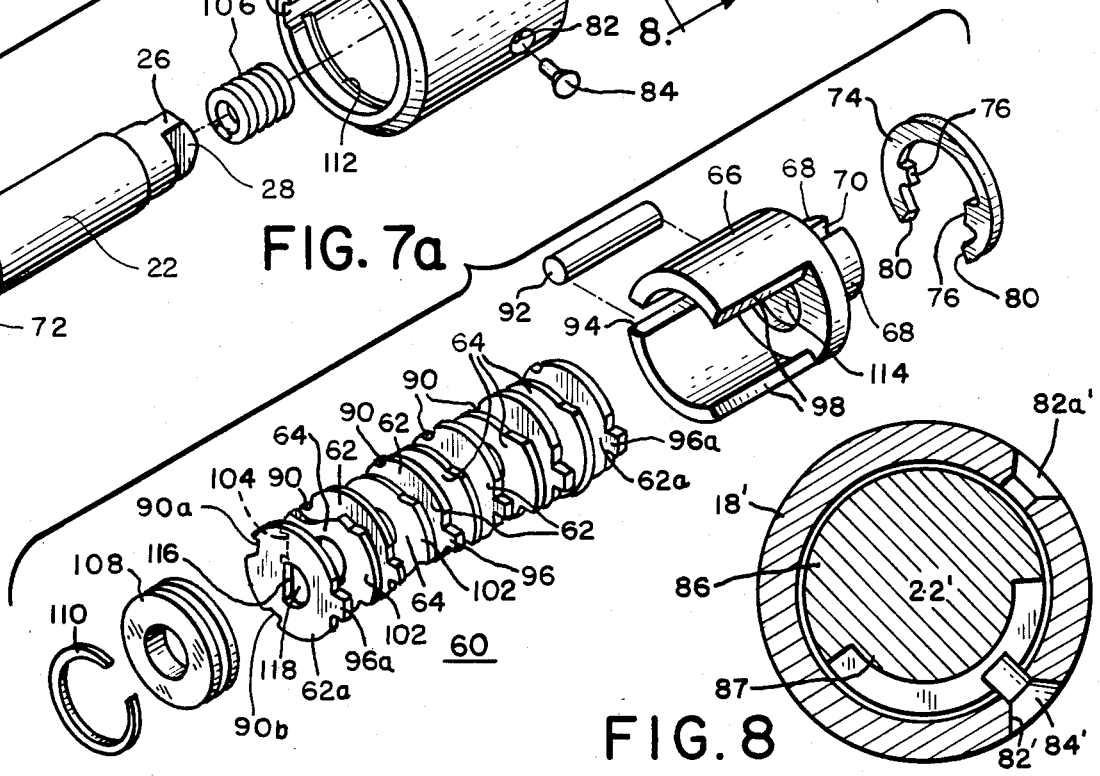
FIG. 8

CARTRIDGE LOCK

TECHNICAL FIELD OF THE INVENTION

The present invention is in the technical field of locks, particularly locks of the type known as cartridge or barrel locks for locking the cover of a meter box, or operating lever of a valve, or the like. Such cartridge locks generally have an enlarged head segment followed by a cylindrical shaft. The shaft extends through or between elements to be locked, restricting movement of these elements. The end of the shaft opposite the head is secured to a locking cap or bracket or the like when in a locked position.

BACKGROUND OF THE INVENTION

Cartridge locks, as mentioned above, are often used to lock meter covers and valve levers. About the end of the cartridge lock opposite the enlarged head are means which couple with complementary elements within a locking cap or bracket to hold the cartridge lock thereto when in its locked position. The enlarged head, together with the device securing the opposite end in some instances, form a barrier past which the element or elements locked cannot pass.

Such locking means include locking balls which, upon locking, are moved to and held in a position partially protruding through apertures in the lock's housing wall. Protruding portions of the locking balls are received by, and contained within, internal pockets in the locking cap or bracket, restraining the movement between these elements that they bridge.

Prior to the present invention, the normal means used to move such locking balls outward to the locked position has been a plunger disposed within an axial core of the cartridge lock, such as the plungers described in U.S. Pat. Nos. 3,186,196 issued June 1, 1965, and 4,015,456 issued Apr. 5, 1977. Along such plungers are two lengths of different circumference and a sloped length therebetween. When the plunger is disposed so that the length of smaller diameter is aligned with the locking balls, there is sufficient space next to the plunger to contain the entire of the locking balls within the lock housing. When the plunger is moved, aligning the larger circumference length with the balls, the balls are pushed partially through the apertures in the housing. Such plungers are typically spring biased in this latter locked position.

To unlock such plunger-type of cartridge locks, unlocking tools are inserted at the free end (enlarged head), which tools are designed to grab the plunger and move it against the spring bias to the unlocked position. The variations in unlocking tools for such type of lock is limited, and thus such systems provide little, if any, master keying potential. In a master keyed system, a number of means for unlocking a single or limited series of locks are distributed to those responsible for that lock or locks while a master means is retained for a number of such locks or series. Loss or misuse of the limited unlocking means confines the security breach, while the holder of the master means retains access to all the locks. Further, given that variations in the unlocking tools for plunger type locks is limited, practicality demands that a given tool operate a significant number of locks, requiring a tight security control of all such tools.

It is an object of the present invention to provide a cartridge lock having the potential for a significant number of combinations of unlocking means. It is an object to provide a cartridge lock with master keying potential. It is an object to provide these features in a cartridge lock of the same or similar outer dimensions as typical plunger type locks in use so that substitution requires no modification of the elements designed to recieve these locks. These and other objects and advantages of the invention are described in more detail below.

DISCLOSURE OF THE INVENTION

The objects of the present invention are provided by a cartridge lock, preferably of substantially the same outer dimensions as heretofore in use, in which the bolting elements are moved from a locked to an unlocked position by the axial rotation of a locking shaft which is interconnected by means transmitting turning force to a cylinder of a rotary disc assembly disposed within the enlarged head of the lock. The locking shaft has bearing surfaces, which when the shaft is rotated to present same to the bolting elements, bears against them, holding them partially protruding from the housing of the lock in the locked position.

Rotary disc assemblies, as described in more detail below, provide not only a significant number of keying combinations, but also provide master keying potential.

Moreover, in preferred embodiment, the cartridge lock is provided with a C-shaped governor element and governor pin. The governor element rotates with the cylinder, and is blocked, stopping turning action, when the locked and unlocked positions are reached. There is provided means, by selection of positions for the pin, of providing opposite turning actions. Moreover, such governor element is positioned so that it does not add to the length of the internal components of the lock.

BRIEF DESCRIPTION OF THE DRAWINGS

FIG. 1 shows a perspective view of a valve in combination with a cartridge lock embodying features of the present invention;

FIG. 2 is a side view of a meter in combination with a cartridge lock embodying features of the present invention;

FIG. 3 is a side view of a meter in combination with the cartridge lock of FIG. 2;

FIG. 4 is a partially cutaway side view of the cartridge lock of FIG. 1, in locked position in combination with a locking cap;

FIG. 5 is a partially cutaway side view of the cartridge lock of FIG. 1, in unlocked position in combination with a locking cap;

FIG. 6 is a cutaway view of the cartridge lock of FIG. 1, taken along line 6 of FIG. 4;

FIG. 6*a* is a cutaway view of the cartridge lock of FIG. 1, taken along line 6*a* of FIG. 5;

FIG. 7 is an exploded view of a portion of the cartridge lock of FIG. 1;

FIG. 7*a* is an exploded view of a portion of the cartridge lock of FIG. 1; and FIG. 8 is a cutaway view along the axial direction of a cartridge lock embodying features of the present invention.

PREFERRED EMBODIMENTS OF THE INVENTION

There is shown in FIGS. 1, 2, and 3 a cartridge lock of the present invention, designated as reference numeral 10, locking several types of devices that will be described in detail below.

Referring to FIG. 4 also, where there is shown in partial cutaway form the cartridge lock 10 in combination with a locking cap, the cartridge lock 10 comprises, within an elongated, stepped housing or body 12, an enlarged head 14 at its top end 16 and stem 18 which terminates at its bottom end 20. The terms "top" and "bottom" used herein have reference to the view point of the user who would normally approach the lock 10 at the top end 16, with the bottom end 20 behind, although it is to be seen that the lock 10 can, and often is, used disposed along the vertical, in which position both ends lie in about the same horizontal plane.

A locking shaft 22 is within the internal core of the housing 12 in axial alignment thereto. In close proximity to the bottom end 20 of the lock 10 are a pair of opposed locking balls 24 which are the bolting elements of the lock 10. As shown in FIG. 4, these locking balls 24 are held protruding partially through the stem 18 through apertures 30 within the housing 12. These apertures 30 are initially wide enough to receive the balls 24 about their widest girth, and then are narrowed or tapered at or about the outer surface of the housing 12, preventing dislodgement of the balls 24 from the cartridge lock 10.

In FIG. 4 the cartridge lock 10 is secured to a locking cap 32 which acts as a means for reversibly enlarging the bottom end 20 of the lock 10. Such locking cap 32 is an element having a cavity 34 dimensioned to receive at least that portion of the stem 18 in which the locking balls 24 are held. Within the cavity 34 are pockets 36 receiving the protruding portions of the locking balls 24 in closely nested relationship. The relative movement between the locking cap 32 and the cartridge lock 10 is limited to the movement allowed the locking balls 24 within the pockets 36, which as shown in FIG. 4 is minimal.

The cavity 34 as shown in FIG. 4 is shaped to follow the outer dimensions of the lock stem 18, whereby the locking cap 32 acts as a protective casing for the portion of the step 18 inserted therein. Since the most basic function of the locking cap 32 is to enlarge the stem 18 at a point close to the lock bottom end 20, it is seen that the same may be accomplished, for instance, with a ring shaped locking cap, even such a cap wherein the bottom end 20 of the lock 10 projects out of the far side.

The bolting elements need not be formed as spherical locking balls 24 as shown, nor need these elements be closely nested with the pockets 36, for instance where more than minimal movement between the cartridge lock 10 and the locking cap 32 is desired.

As shown in FIG. 5, upon axial rotation of the locking shaft 22 from the point where its bearing surfaces 26 face the locking balls 24 (as shown in FIG. 4) to the point where its cutaway surfaces 28 face the locking balls 24, the locking balls 24 are retracted into the stem 18 of the lock 10, freeing the cartridge lock 10 from the locking cap 32. This is the unlocked position.

The embodiments shown in the drawings include a locking shaft 22 wherein the bearing surfaces 26 are disposed diametrically opposite each other, as are the cutaway surfaces 28, and thus the locking/unlocking action of the locking shaft 22 is preferably a rotation through a 90° angle, presenting the center of one or the other of the two surface forms to the locking balls 24. Other dispositions of the two surface forms relative each other would require a commensurate axial rotation of the locking shaft 22.

In the emboidment shown, the locking shaft 22 is rotated clockwise for the unlocking function, and then counter-clockwise for the locking function, but can be modified so that the directions of turning for each function are reversed, as will be discussed in further detail below.

One use of the cartridge lock 10 in combination with a locking cap 32, as shown in FIG. 1, is to restrict relative movement between two elements secured thereby. In FIG. 1 is shown an operating lever 38 of a valve 40, which lever 38 is normally turnable, being locked to a stationary arm 42. Each of the lever 38 and arm 42 are provided with alignable openings through which the stem 18 of the cartridge lock 10 is passed. Upon securing the locking cap 32 about the bottom end 20 of the lock 10, the lever 38 is locked into its position. Neither the lock's enlarged head 14 nor the locking cap 32 can be passed through the openings in the lever 28 and arm 42. The lever 38 is released upon releasing the locking cap 32 from the lock 10 by means of appropriate key 44 as will be discussed below.

The cartridge lock 10 can be used to lock a meter 50 such as shown in FIGS. 2 and 3 by a similar mode. Here the lock stem 18 but not its enlarged head 14 fits through an aperture within the meter cover 52. The cartridge lock 10, about its bottom end 20, is locked into a stationary bracket 53 beyond the cover 52 by the same method as is described above for the locking cap 32. Such a bracket 53 is, like a locking cap 32, a means obstructing withdrawal of the lock 10 from the elements through which the stem 18 passes, and in addition is a portion of, or at least is mounted stationarily on, one of the elements to be tied together by the cartridge lock 10. Such a bracket 53 thus is like a locking cap integrated into one of the plurality of elements to be locked together.

In FIG. 3 the meter cover 52 and cartridge lock 10 are shown protected by a shroud piece 54 mounted by means not shown onto the meter 50. Such shroud piece 54 has a hole 56 through which the entire cartridge lock 10 passes, and is set to align with the top end 16 of the lock 10, permitting key access to the lock 10 without removal of the shroud piece 54. That opening 56 in the shroud piece 54 can be covered, if desired, with a breakable seal or the like (not shown) to provide a total encasement of the lock 10. Upon breaking such a seal to gain key access to the lock 10, the opening 56 then could be protected again merely by applying a new seal.

The locking shaft 22 if functionally associated with a rotary disc cylinder assembly 60 mounted within the enlarged head 14 of the cartridge lock 10. The assembly 60, as best seen in FIG. 7*a*, comprises a plurality of spacers 64 sandwiched between discs 62, a cylinder 66 housing the discs 62 and spacers 64, and a locking bar 92. The cylinder 66, in preferred embodiment, is formed with a tail piece 68 jutting out towards the bottom end 20 of the lock 10 and having a channel 70 that opens towards the bottom end 20. The end of the locking shaft 22 is cutaway to form two opposed flat contact surfaces 72. This end of the shaft 22 is disposed within the tail piece channel 70, the contact surfaces 72 meeting with the closely adjacent sides of the channel 70. Upon axial rotation of the cylinder 66, the locking shaft 22 is turned likewise by the turning force transmitted through the tail piece 68. In preferred embodiment, the end of the locking shaft 22 is cutaway deeply to provide maximum breadth to the contact surfaces 72 formed thereon, and thus maximum contact area between the faces 78 of the tail piece 68 and locking shaft 22. The contact surfaces 72 are not, however, completely coextensive with the channel 70. As best seen in FIGS. 6 and 6*a*, the breadth of the contact surfaces 72 are limited by the diameter of the locking shaft 22 and they end short of the ends of the channel 70.

A govenor plate 74 is mounted about the tail piece 68. This govenor plate 74 is formed with two opposed tabs 76 extending radially inward towards the end of the locking shaft 22 into the end spaces within the tail piece channel 70 left by the locking shaft 22. The govenor plate 74 thus, like the locking shaft 22, will be rotated together with the tail piece 68 upon rotation of the cylinder 66. Moreover, in such embodiment is realized an overlapping of the flattened end of the locking shaft 22 (the contact surface portion) with both the tail piece 68 and the govenor plate 74, providing strength to this area of locking shaft interconnection.

The govenor plate 74 is generally C-shaped, having end faces 80 spaced apart from each other at an angle, here an angle of somewhat over 90°, that in part determines the angle through which the locking shaft 22 will rotate. Means for limiting the rotation of the govenor plate 74, and hence the rotation of all interconnected rotatable elements, are provided by a govenor pin 84 mounted so as to bar further rotation of the govenor plate 74 when met by either of the govenor plate's end faces 80. Since in the embodiment shown a 90° rotation is desired, and the end faces 80 meet the pin 84 at opposite sides of the pin 84, the relative angular positions of the faces 80 must be adjusted upward of 90° depending on the thickness of the govenor pin 84. Hence, the govenor plate 74 will rotate 90° when it moves from a position in which one of its end faces 80 is disposed next to one side of the pin 84 to a position at which its other end face 80 is moved up next to the other side of the pin 84. The turning of the govenor plate 74 is thus limited to alternative turnings in the clockwise and then the counterclockwise direction, each no more than 90°.

In preferred embodiment, the pin 84 is mounted through a govenor pin hole 82 that extends completely through the housing 12 of the lock 10, and further each lock 10 is provided with an alternative pin hole 82*a* to provide capacity to alter the position of the govenor pin 84. (The governor pin 84 lodged within the alternative governor pin hole 82*a* is shown in phantom in FIGS. 6 and 6*a*.) In the embodiment shown, from the perspective of one facing the top end 16 of the lock 10, clockwise rotation is required to go from a locked position (FIGS. 4 and 6) to an unlocked position (FIGS. 5 and 6*a*). Counterclockwise rotation reverses the process, locking the lock 10. If the governor pin 84 were placed instead in the alternative pin hole 82*a* provided, opening the lock 10 would require counterclockwise rotation. This potential for an alternative governor pin position provides potential for modifying the lock 10 as to its direction of turning.

The length of the enlarged head 14 determines the number of discs 62 of a given thickness that can be held therein, which in turn determines the number of key combinations available. As best shown in FIG. 5, the governor plate 74 is disposed behind the main body of the cylinder 66, both of which occupy a portion of the cavity within the enlarged head 14. Elimination of the governor plate 74 from the enlarged head 14 is another means of providing that function without providing additional space in the enlarged head 14 therefor.

In place of the governor plate 74 could be used a governor shaft piece 86 formed integral with the locking shaft 22' by cutting away therefrom, at some position along its length with the stem 18', a partial peripheral groove 87 receiving a governor pin 84' as shown in FIG. 8.

The locking shaft 22 is biased with a spring 106 mounted in the bottom end of the cavity of the lock's stem 18 to hold the shaft 22 more securely within the tail piece 68, and for this same purpose the tip of the locking shaft 22 is tapered so as to held without slipping in the end of the spring 106.

Referring now in more detail to the rotary disc cylinder assembly 60, the cylinder 66 has a side bar slit 94 in which is lodged a side bar 92 when in the locked position. The side bar 92 functions as follows. Normally the peripheral edges of at least some of the discs 62 bear against the side bar 92, holding it outwardly within the side bar slit 94. In this position, the side bar 92 partially extends beyond the side bar slit 94 into groove 93 in the lock housing 12, locking the cylinder 66 to the housing 12. Each disc 62, however, has at least one peripheral notch 90 and by turning the key 44 (clockwise turning for the embodiment shown) in the lock 10, the discs 62 are brought into a position in which their notches 90 are aligned and collectively form a groove at the position of the side bar slit 94. The side bar 92 is able to move radially inward to a position where it is now lodged both within the groove formed by the alignment of disc notches 90 and the cylinder's side bar slit 94, releasing the cylinder 66 from the housing 12. The cylinder 66 is thus free to turn with the discs 62.

Further turning of the key 44 in a clockwise direction will rotate the cylinder 66 through an angle by means of small axial protrusions 96 on at least one of the discs 62, for instance the inner-most disc 62*a* which has been moved by key turning to meet the side surface of a side opening 98 within the cylinder 66, and thus upon further key turning transmits torque to the cylinder 66. In the embodiment shown the cylinder side opening 98 is positioned opposite the side bar slit 94. As the cylinder 66 rotates, the side bar 92 moves together with it, away from the housing groove 93, being held partially within the alignment of disc motches 90, in which position it locks the turning movement of all the discs 62 with the cylinder 66.

The turning of the cylinder 66, as described above, causes commensurate rotation of the locking shaft 22 and governor plate 74. The governor plate 74 will meet with the governor pin 84, preventing further clockwise rotation of the rotary disc cylinder assembly 60 at the point where the locking shaft 22 is in the unlocked position.

Counterclockwise rotation of the key 44 in the lock 10 will bring the rotary disc cylinder assembly 12 again into the locked position. The cylinder 66, side bar 92, and discs 62 will again move together until the rotation brings the side bar 92 into alignment with the side bar slit 94. At least one of the discs 62, here both the forward-most and rear-most discs 62*a*, are formed with two notches 90*a*, 90*b*. These notches 90*a*, 90*b* are lifting means, each having one straight side edge and one slanted side edge. Upon unlocking by means of clockwise rotation, it is the left lifting notches 90*a* as seen on FIG. 7 which will become aligned with and receive the side bar 92. Upon counterclockwise rotation, the slanted side edges will be the following edges and will lift the side bar 92 radially outwardly whereby the cylinder 66 will be released from the discs and locked again to the housing 12. Further turning of the key 44 to the key releasing position will bring the discs 62 into positions where their notches 90 are again scattered.

When the lock 10 is modified for reverse turning function, by placing the governor pin 84 in the alternative governor pin hole 82*a*, the right hand lifting notches 90*b* are then the operative notches that will become aligned with the other notches 90 to form a groove for the side bar 92.

The spacers 64 are each formed with a flange 102 which is seated within the cylinder side opening 98 and thus the spacers 64 always and only move together with the cylinder 66. Each spacer 64 also has an elongated peripheral recess 104 which in the embodiment shown is positioned opposite the flange 102 and which avoids the edge of the spacers 64 from becoming or forming a barrier to the side bar 92 even though none of the spacers 64 are rotated until the discs 62 are aligned to permit rotation of the cylinder 66.

The cartridge lock 10 is also provided with a disc retainer 108 upon which is mounted a retainer ring 110, and which together are mounted within the housing 12 forward of the rotary disc assembly 60, the retaining ring 110 being snapped into a retainer ring groove 112 formed on the internal wall of the housing 12, mounting the disc retainer 108 within the housing 12.

The key 44 transmits turning force to the discs 62 in conventional manner for disc cylinder locks, a cut on the key 44 bearing against the linear edges 116 of the disc center openings 118, and given a plurality of key cuts, the discs 62 are each separately turned through a predetermined angle to become aligned with the side bar 92. For each disc such angle is determined by the position of its notch 90 prior to key turning and is the combination value of that disc 62. In the embodiment shown, for six discs 62 merely a few variations in combination values will provide a vast number of available lock combinations, which are determined both by the combination values of the individual discs 62 and by the placement of such discs 62 in the alignment of discs 62. Further, the construction as described above whereby the lock 10 can be assembled for either a clockwise or counterclockwise unlocking action by choice of placement of the governor pin 84 (into either of the governor pin holes 82, 82*a*) doubles the number of combinations available for a given number of choices of combination values for each disc 62.

The rotary disc cylinder assembly 60 provides master keying potential as follows. The discs 62 have notches 90 at various positions about their periphery. Such discs 62 have a number of positions for such notches 90, for instance five or six possible choices. To provide a master keyed system, one of the discs 62 is provided with two notches 90, one in a series corresponding to a master key, which is the same position for each lock 10 in the series, and if the possible positions are for instance six, a second notch 90 chosen from the five remaining positions. In such series, all other discs 62, as to their position of notches, would be identical. Here, in the simplest of series, there would be five locks 10 each that could be actuated by a key 44 which could not operate any other of the five, and each is operable by a single master key. If two such discs 62 were so notched for master keying, the potential combinations in the system is raised to twenty five, and so forth. Moreover, changing the position of just one of the mastered keying notches provides a new master key series.

The cartridge lock 10 when formed to dimensions compatable to fittings used heretofore for former cartridge locks is extremely small, the enlarged head 14 being only from about ½ inches to about ¾ inches in length along its outer wall. Since the number of lock combination depends on the number of discs 62 that can be fitted within this head 14, the placement of the governor plate 74 about the locking shaft 22 / cylinder 66 interconnection and mating it to the same tail piece channel 70 as the locking shaft 22 eliminates the need to provide separate space for the governor plate 74 within the head 14.

In another preferred embodiment, however, in which the use of separate space within the enlarged head 14 for the governor function is also avoided, the governor function is provided by the governor shaft piece 86 as described above.

In further preferred embodiment, the bottom or closed end of the cylinder 66 has a center recess 114 whereby the rim formed surrounding the recess 114 bears against the bottom or rear-most disc 62*a*, while a key 44 of greater length than the alignment of discs 62 and spacers 64 can be used, its tip extending beyond out into the recess 114, the wall thereof acting as a bearing surface for the tip of the key 44.

INDUSTRIAL APPLICABILITY OF THE INVENTION

The present invention is applicable to the security industry, and in particular to the field of locks known as cartridge or barrel locks.

The present invention is not limited to the particular embodiments and elements described above and the invention is as described in the following claims.

I claim:

1. A cartridge lock comprising an elongated housing and disposed therein a rotary disc assembly, a locking shaft and at least one bolting element;

said rotary disc assembly comprising a plurality of discs aligned concentrically within a cylinder, said cylinder being interconnected to one end of said locking shaft by means transmitting turning force therebetween;

said bolting element being partially disposed within a housing aperture adjacent said locking shaft;

said lock and locking shaft having a normal locked and an unlocked position, said locking shaft moving between said positions by axial rotation;

said locking shaft having at least one bearing surface which, when said locking shaft is at its locked position, is presented to said bolting element holding said bolting element partially protruding from out said housing, and when said locking shaft is rotated to its unlocked position, said bearing surface is translated to a position away from said bolting element, wherein upon key action turning said cylinder of said rotary disc assembly in a first direction, said locking shaft is rotated from its locked to its unlocked position and upon key action turning said cylinder in a second and opposite direction, said locking shaft is rotated back to its locked position;

a governor pin disposed protruding axially inwardly through said housing;

said cylinder further including a tailpiece about which is seated a C-shaped governor plate, the ends of said C-shaped governor plate forming a first and a second face that meet said governor pin at opposite sides of said governor pin when said locking shaft reaches one of its locked and unlocked positions; and a first and a second mounting hole in said housing for said governor pin whereby when said governor pin is mounted in the first mounting hole, the first face of said governor plate meets said governor pin when said locking shaft is at its unlocked position and when said governor pin is mounted in the second mounting hole the first face of said governor plate meets said governor pin when said locking shaft is at its locked position.

2. A cartridge lock comprising an elongated housing and disposed therein a rotary disc assembly, a locking shaft and at least one bolting element;

said rotary disc assembly comprising a plurality of discs aligned concentrically within a cylinder, said cylinder being interconnected to one end of said locking shaft by means transmitting turning force therebetween;

said bolting element being partially disposed within a housing aperture adjacent said locking shaft;

said lock and locking shaft having a normal locked and an unlocked position, said locking shaft moving between said positions by axial rotation;

said locking shaft having at least one bearing surface which, when said locking shaft is at its locked position, is presented to said bolting element holding said bolting element partially protruding from out said housing, and when said locking shaft is rotated to its unlocked position, said bearing surface is translated to a position away from said bolting element, wherein upon key action turning said cylinder of said rotary disc assembly in a first direction, said locking shaft is rotated from its locked to its unlocked position and upon key acting turning said cylinder in a second and opposite direction, said locking shaft is rotated back to its locked position;

a governor pin disposed protruding axially inwardly through said housing;

a governor shaft piece comprising a partial peripheral groove about a portion of the circumference of said locking shaft, said groove receiving said governor pin and forming at its two ends a first and a second face that meet said governor pin at opposite sides of said governor pin when said locking shaft reaches one of its locked and unlocked positions; and a first and a second mounting hole in said housing for said governor pin whereby when said governor pin is mounted in the first mounting hole, the first face of said governor shaft piece meets said governor pin when said locking shaft is at its unlocked position and when said governor pin is mounted in the second mounting hole the first face of said governor shaft piece meets said governor pin when said locking shaft is at its locked position.

* * * * *